US006846165B2

(12) United States Patent
Wanschura et al.

(10) Patent No.: US 6,846,165 B2
(45) Date of Patent: Jan. 25, 2005

(54) HYDROSTATIC MACHINE

(75) Inventors: Guenther Wanschura, Ulm (DE); Reinhold Schniederjan, Neu-Ulm (DE); Jürgen Gintner, Elchingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 164 days.

(21) Appl. No.: 10/275,169

(22) PCT Filed: Jan. 25, 2001

(86) PCT No.: PCT/EP01/00819

§ 371 (c)(1),
(2), (4) Date: Nov. 1, 2002

(87) PCT Pub. No.: WO01/83988

PCT Pub. Date: Nov. 8, 2001

(65) Prior Publication Data

US 2003/0077189 A1 Apr. 24, 2003

(30) Foreign Application Priority Data

May 3, 2000 (DE) ..... 100 21 485

(51) Int. Cl.[7] ..... F04B 1/12; F04B 23/08; F04B 1/26; F01B 3/00; F01B 13/04

(52) U.S. Cl. ..... 417/269; 417/199.1; 417/216; 417/222.1; 92/71; 91/499

(58) Field of Search ..... 417/199.1, 216, 417/222.1, 462, 269; 92/71; 91/499, 500

(56) References Cited

U.S. PATENT DOCUMENTS 2,371,974 A 3/1945 Neuland
3,996,841 A * 12/1976 Gostomski, Jr. ..... 91/499
4,041,843 A * 8/1977 Mischenko et al. ..... 91/499
4,624,175 A * 11/1986 Wahlmark ..... 91/487
5,354,180 A * 10/1994 Forster ..... 417/199.1

FOREIGN PATENT DOCUMENTS

| | | |
|---|---|---|
| DE | 1 075 915 | 2/1960 |
| DE | 195 12 993 A1 | 3/1996 |
| DE | 197 55 661 A1 | 9/1998 |
| DE | 198 28 180 A1 | 1/2000 |
| EP | 0 051 795 | 5/1982 |
| FR | 629 542 | 11/1927 |
| GB | 1 487 542 | 10/1977 |

* cited by examiner

*Primary Examiner*—Justine R. Yu
*Assistant Examiner*—Timothy P. Solak
(74) *Attorney, Agent, or Firm*—Scully, Scott, Murphy & Presser

(57) ABSTRACT

The invention relates to a hydrostatic machine (1) comprising at least one first hydrostatic unit (E1) and one second hydrostatic unit (E2), each hydrostatic unit (E1, E2) comprising respective pistons (14*a*, 14*b*) guided in respective cylinder drums (13*a*, 13*b*) and supported by respective swiveling bodies (17*a*, 17*b*) that can be adjusted by respective adjustment devices (6*a*, 6*b*), and further comprising respective control bodies (25*a*, 25*b*). A one-piece main housing body (2) radially surrounds the cylinder drums (13*a*, 13*b*), the control bodies (25*a*, 25*b*), and the adjustment devices (6*a*, 6*b*) of both hydrostatic units (E1, E2), and assigns pressure channels for supplying a pressure medium to and discharging it from the control bodies (25*a*, 25*b*) of both hydrostatic units (E1, E2). A first add-on housing body (3*a*) is disposed on a first side of the main housing body (2), and bears a swiveling body (17*a*) of the first hydrostatic unit (E1). On a second side of the main housing body (2) a second add-on housing body (3*b*) is provided which bears the swiveling body (17) of the second hydrostatic unit (E2).

17 Claims, 8 Drawing Sheets

HYDROSTATIC MACHINE

BACKGROUND OF THE INVENTION

The invention relates to a hydrostatic machine according to the precharacterising clause of claim 1.

A hydrostatic machine of this type is described in DE 195 12 993 A1.

This known hydrostatic machine is a so-called double-pump unit with a one-piece main housing body having a centrally arranged housing centre wall and on each side a housing end wall, respective housing chambers being arranged between the housing centre wall and the housing end walls, in which housing chambers respective cylinder drums with pistons guided therein such that they can be displaced substantially axially to and fro are arranged, which pistons are supported on a swivelling body likewise arranged in the housing chamber. The cylinder drums are mounted on respective drive shafts which internally are rotatably mounted in bearing bores of the housing centre wall and externally pass through the associated housing end wall in a bearing hole and are likewise rotatably mounted therein. Each swivelling body is assigned an adjusting device with an adjusting element movable to and fro and likewise mounted, such that it can be displaced to and fro, in the one-piece main housing body. The two drive shafts of the first and second hydrostatic unit thus formed are connected to each other in a rotationally fixed manner in the region of the housing centre wall by a coupling piece in the form of a muff. In this known hydrostatic machine, the housing chambers are assigned a respective access opening which is arranged transversely to the associated drive shaft and through which the associated swivelling body is mountable and demountable. The access openings are closable by a respective covering plate, on which bearing surfaces for a swivelling bearing of the associated swivelling body are formed. On the side opposite the covering plates, bearing surfaces for the swivelling bodies are arranged on the one-piece main housing body. Whereas one housing end wall serves as a mounting-on flange for the hydrostatic machine, onto the other housing end wall is mounted an auxiliary pump which is driven by the associated drive shaft projecting into the auxiliary pump body.

This known design is disadvantageous for several reasons. First of all, the main housing body is not only of a complicated structural shape due to the additional presence of the transversely directed access openings, but is also considerably weakened by the access openings, so that the main housing body must be stably designed in its remaining structural sections to be able to take the stresses placed upon it in operation. A further disadvantage is that two additional covering plates have to be provided, as a result of which not only is the number of components increased, but they have also to be mounted and sealed and they contribute to the complicated construction. Moreover, in this known design, the swivelling bearings for the swivelling bodies are each formed partly on the main housing body and partly on the associated covering plate. A further disadvantage with this is that, owing to scarcely avoidable tolerances, positional differences between the bearing surfaces arranged on the main housing body and the bearing surfaces arranged on the covering plates are to be expected, which leads to impairment of the swivelling bearings for the swivelling bodies, in particular under high stresses, as a result of which the service life of the swivelling bearings and thus also of the hydrostatic machine as a whole can be impaired.

SUMMARY OF THE INVENTION

The object on which the invention is based is to simplify a hydrostatic machine of the type specified at the outset, while ensuring a stable construction. Not only is the construction of the one-piece main housing body to be simplified, but also the swivelling bearings for the swivelling body, the intention further being to achieve not only a simple but also a precise production of the swivelling bearings.

This object is achieved by the features of claim 1. Advantageous developments of the invention are described in the subclaims.

In the hydrostatic machine according to the invention, provision is made for a first add-on housing body which is mounted onto the main housing body and on which the swivelling body of the first hydrostatic unit is mounted, and for a second add-on housing body which adjoins the main housing body and on which the swivelling body of the second hydrostatic unit is mounted. In this case, the first and the second add-on housing body form end-side add-on parts arranged in the region of the end-side housing openings which are required in any case for the passage of the drive shafts and in the region of which the add-on housing bodies can be stably mounted onto the main housing body while ensuring a simple design. In this case, the end-side openings may be designed to be of such a size that the cylinder drums and the swivelling bodies of the first and second hydrostatic unit are each mountable and demountable through the end-side openings. An essential advantage of the design according to the invention is also that the swivelling bearings are each formed on one and the same component, namely on the first and second add-on housing bodies. In this case, the respective bearing surfaces of the swivelling bearings on the add-on housing bodies can each be produced not only in a simple and easily accessible manner but also, when clamped to machining equipment, in a precise manner, as a result of which the bearing quality is improved and the service life of the swivelling bearing is increased. A further advantage of the design according to the invention is that both the swivelling bearing and the bearing for the associated drive shaft are formed on the first and second add-on housing body, as a result of which not only is a compact construction achieved but likewise also a simple and precise production of both bearing formations on respectively one and the same add-on housing body. It is also to be seen as a further advantage of the design according to the invention that the housing of the hydrostatic machine consists of just three components, namely the one-piece main housing body and the two add-on housing bodies.

The add-on housing bodies can also be designed as components which, after associated fastening elements, in particular fastening screws, have been released, are rotatable about the axis of rotation of the associated drive shaft and can be mounted onto the main housing body in different rotational positions. This is particularly advantageous when the hydrostatic units are formed by axial piston machines. In fact, the direction of rotation of the interconnected drive shafts can be determined by mounting on the add-on housing bodies in mounting-on positions rotated through 180°. As a result, the usability of the hydrostatic machine and its adaptation to different operating conditions are improved. A factor which also contributes to this is that, in the design according to the invention, the drive shafts can each form a mounting unit with the associated add-on housing body if both mounting units are designed mirror-symmetrically with respect to a centre plane, extending at right angles to the drive-shaft axes, of the main housing body. Such a design enables the hydrostatic units to be mounted in a manner such that they are rotated through 180° with respect to a transverse axis running in the centre plane. This achieves not only the effect that the output end of the drive-shaft arrangement can be arranged on one side or the other as desired, but it is also possible to determine the direction of rotation of the hydraulic unit in the way described above.

Further features of developments lead to simple, small or compact, and inexpensively producible and assemblable constructions, as a result of which the hydrostatic machine is further improved.

BRIEF DESCRIPTION OF THE DRAWINGS

The invention and further advantages which can be achieved thereby are explained in more detail below with the aid of advantageous design features of an exemplary embodiment. In the drawing.

DESCRIPTION OF THE PREFERRED EMBODIMENTS

Figure 1:
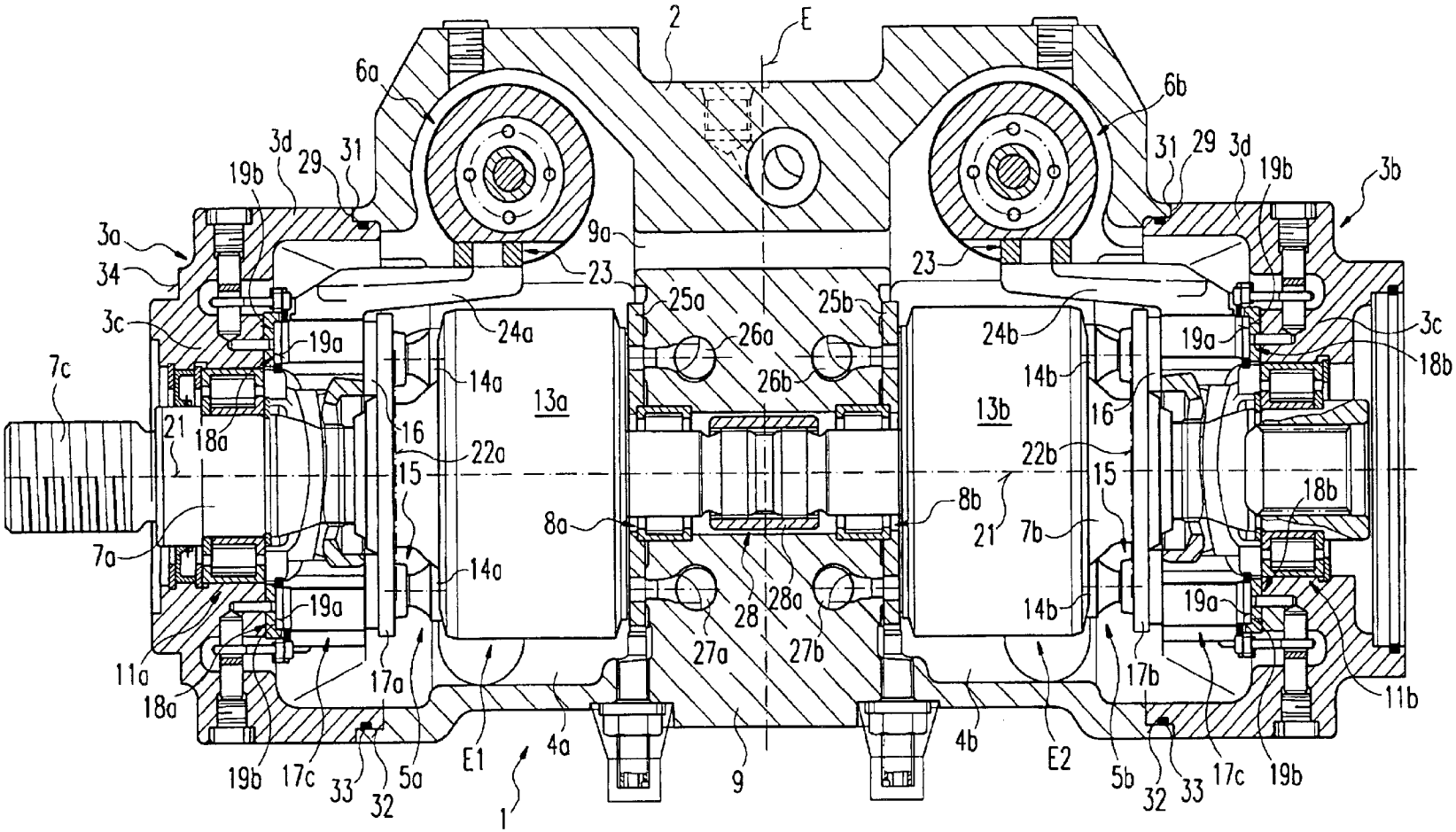
FIG. 1 shows an axial section of a hydrostatic machine according to the invention.

The main parts of the hydrostatic machine, denoted as a whole by 1, are a main housing body 2, two add-on housing bodies 3*a*, 3*b* mounted onto the main housing body at mutually opposite end sides, two housing chambers 4*a*, 4*b*, in each of which is arranged a hydrostatic unit E1, E2, preferably in the form of a piston machine 5*a*, 5*b*, the piston machines 5*a*, 5*b* each being adjustable with respect to their throughput volume by an adjusting device 6*a*, 6*b*. The piston machines 5*a*, 5*b* each have a drive shaft 7*a*, 7*b* which are arranged coaxially, the drive-shaft ends which face each other being rotatably mounted, by means of bearings 8*a*, 8*b*, on a housing centre wall 9 extending between the housing chambers 4*a*, 4*b*. The ends, which face away from each other, of the drive shaft 7*a*, 7*b* are mounted, by means of rotary bearings 11*a*, 11*b*, on the add-on housing bodies 3*a*, 3*b*, having through-holes in which the rotary bearings 11*a*, 11*b* are arranged. A channel 9*a* connecting the chambers 4*a*, 4*b* is provided in the housing centre wall 9, preferably in the region of the side on which the adjusting devices 6*a*, 6*b* are arranged.

The piston machines 5*a*, 5*b* each have a cylinder drum 13*a*, 13*b*, in which pistons 14*a*, 14*b* are mounted, such that they can be displaced to and fro, in piston holes arranged approximately axially parallel and distributed over the periphery and are axially supported on a swash plate 17*a*, 17*b* by spherical joints 15 arranged at their outwardly oriented ends and with spherical piston heads mounted swivellably in slide shoes 16, being swivellable about swivel axes 22*a*, 22*b* on a swivelling body 17*c* with swivelling runners, arranged on both sides of the drive shaft 7*a*, 7*b*, of a swivelling bearing 18*a*, 18*b* with circular-arc-shaped convex bearing surfaces 19*a* on correspondingly circular-arc-shaped concave bearing surfaces 19*b* on the inner sides of the add-on housing bodies 3*a*, 3*b*, the swivel axes 22*a*, 22*b* each extending at right angles to the axes of rotation 21 of the drive shafts 7*a*, 7*b*. The swivelling or adjusting devices 6*a*, 6*b* provided for this are each formed by a hydraulic piston cylinder connected by a connecting joint 23 to a swivelling arm 24*a*, 24*b* projecting inwards from the swivelling body 17*c*. The piston cylinders extend transversely to the axis of rotation 21, being situated in lateral chamber extensions of the housing chamber 4*a*, 4*b* and being mounted correspondingly displaceably in the main housing body 2.

The swash plates 17*a*, 17*b* surround the associated drive shaft 7*a*, 7*b* annularly. The cylinder drums 13*a*, 13*b* are each connected in a rotationally fixed manner to the associated drive shaft 7*a*, 7*b*, and their inwardly directed end sides each bear against a control plate 25*a*, 25*b* with control openings connected, by supply channels 26*a*, 26*b* and discharge channels 27*a*, 27*b* running in the housing centre wall 9, to inlets and outlets (not shown in FIG. 1) for a hydraulic medium, in particular hydraulic oil, which are arranged on the main housing body 2.

The ends, which face each other, of the drive shafts 7*a*, 7*b* are preferably connected to each other in a rotationally fixed manner. A coupling 28, for example in the form of a coupling sleeve 28*a*, can serve this purpose, lapping over the two drive-shaft ends in the form of a muff and positively connecting them to each other, for example, by means of intermeshing teeth arranged on the circumferential surface of the drive-shaft ends and on the inner circumferential surface of the coupling sleeve 28*a*. The coupling sleeve 28*a* is radially spaced from the inner wall of the bearing hole present in the housing centre wall 9. The external teeth on the drive-shaft ends and preferably also the internal teeth on the coupling sleeve 28*a*, or their tooth flanks, are preferably curved convexly about axes passing transversely through the drive-shaft ends. Such "crowned" toothing enables compensation of slightly tilted positions of the drive shafts 7*a*, 7*b*, which are scarcely avoidable owing to manufacturing tolerances which are present. The drive shafts 7*a*, 7*b* can thus deviate slightly from an ideal coaxial arrangement, as a result of which deflections of the drive shafts 7*a*, 7*b* are avoided.

The designs and functions of the piston machines 5*a*, 5*b* are known in detail and do not therefore need further description.

The add-on housing bodies 3*a*, 3*b* each have a radial body wall 3*c*, on the inner sides of which the bearing surfaces 19 for the swivelling body 17*c* are formed. In the context of the invention, the body walls 3*c* may be mounted directly on end-side mounting-on surfaces 29 on the main housing body 2 and sealed. In the present exemplary embodiment, the add-on housing bodies 3*a*, 3*b* are designed in the shape of a pot with peripheral walls 3*d* projecting inwards from each of the body walls, the peripheral walls 3*d* bearing by their end-side mounting-on surfaces 31 on the mounting-on surfaces 29 and being sealed. For the purpose of centring and radially positive fastening, it is advantageous to design the mounting-on surfaces 29, 31 in a step-shaped manner, as a result of which the mounting-on surfaces are combined with interlocking centring surfaces 32 in the form of a spigot and socket. For sealing, provision is preferably made for a sealing ring 33, e.g. an O-ring, which is assigned in a known manner to the centring surfaces 32 in an outer annular groove or inner annular groove.

It is advantageous to design the hydrostatic machine 1 in a mirror-inverted manner, with respect to a centre plane E extending between the piston machines 5*a*, 5*b* in the region of the housing centre wall 9 at right angles to the common axis of rotation 21, such that the piston machines 5*a*, 5*b* can be mounted on the main housing body 2 preferably with the associated add-on housing bodies 3*a*, 3*b* in positions rotated through 180°. This is particularly advantageous when the add-on housing bodies 3*a*, 3*b* are designed the same at their sides facing the main housing body 2, but differently at their sides facing away from each other. In this case, different mounting-on situations can be provided, on one side of the main housing body 2 or the other as desired, determined by the different design of the add-on housing bodies 3*a*, 3*b*. In the present exemplary embodiment, the add-on housing body 3*a*, on the left here, through which the drive-shaft journal 7*c* of the drive shaft 7*a* passes and which has a mounting-on surface 34 in the form of an annular step, serves for the mounting of the hydrostatic machine 1 onto a carrier (not shown). The other add-on housing body 3*b* may serve for the mounting-on of at least one further assembly or one further hydraulic unit E3, for example an auxiliary pump (not shown in FIG. 1).

It is also advantageous to design the fastening means, effective between the add-on housing bodies 3*a*, 3*b* and the main housing body 2, in such a way that the add-on housing bodies 3*a*, 3*b* can be mounted onto the main housing body 2, as desired, in positions rotated through 180° about the axis of rotation 21 and can be connected to the associated adjusting device 6*a*, 6*b*. This makes it possible to reverse the direction of rotation of the piston machines 5*a*, 5*b* in each case and adapt it to requirements which exist at the installation site.

Figure 2:
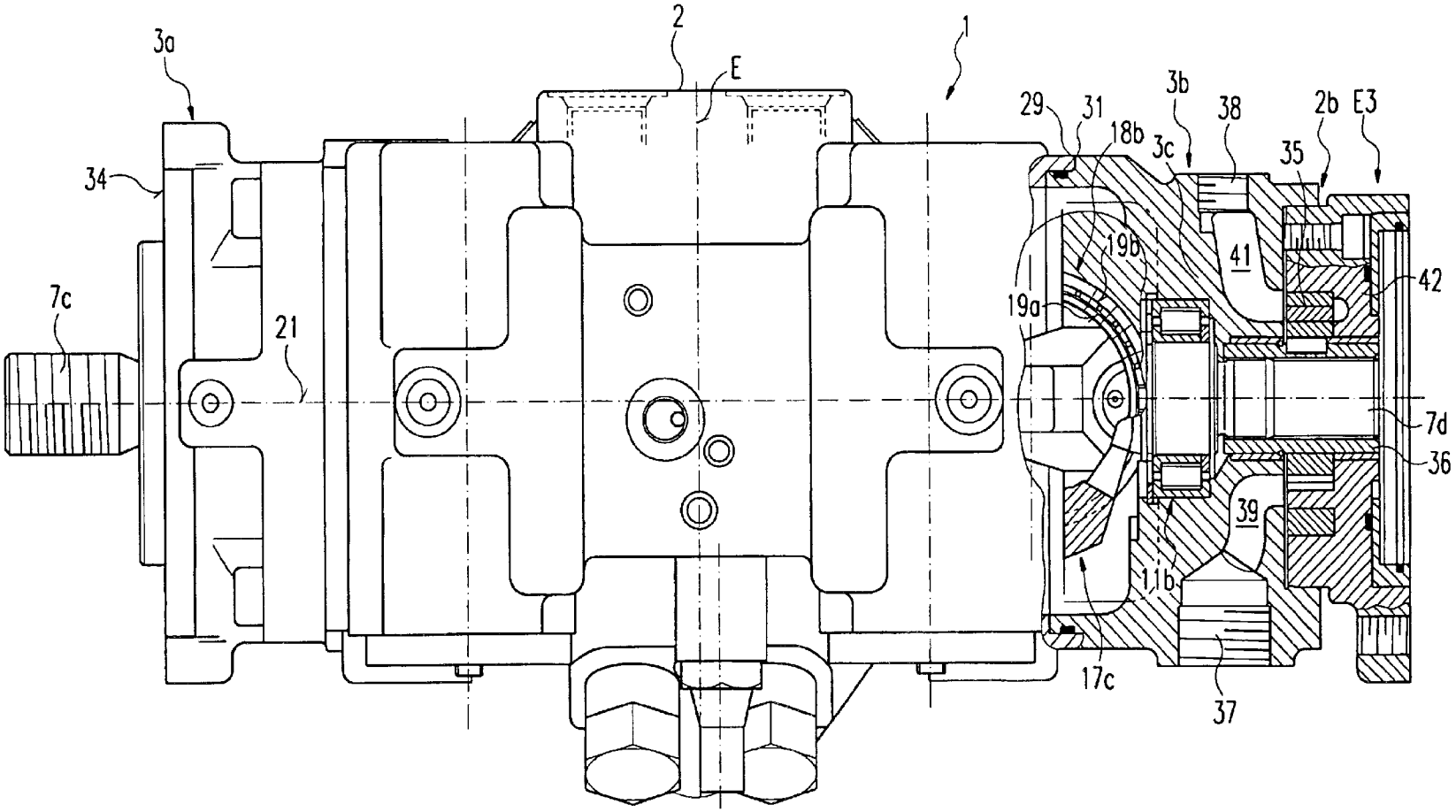
FIG. 2 shows the machine in a position rotated through 90° about its axis of rotation and partially sectioned.

In the exemplary embodiment according to FIG. 2, the add-on housing body 3*b* facing away from the drive journal 7*c* carries a third hydraulic unit E3 or an additional assembly, here in the form of an auxiliary pump 35 driven by an extended drive journal 7*d* of the associated drive shaft 7*b*. This is, for example, a gear pump, with at least one delivery gear 35 which is directly fastened to the drive journal 7*d* or is seated in a rotationally fixed manner on a sleeve 36 connected in a rotationally fixed manner to the drive journal 7*d*. In this design, the radial body wall 3*c* is widened, an inlet 37 and an outlet 38 being arranged therein, preferably at the periphery, from which respective connecting channels 39, 41 extend to the pressure and low-pressure zone of the gear pump. The delivery gear 35 is situated in a chamber of a mounting-on plate 42 which is mounted at the end side onto the body wall 3*c* and at the same time preferably fits into a recess in the body wall 3*c* and is centred therein. The housing 2*b* of the third hydrostatic unit E3 is denoted by 2*b*.

Figure 3:
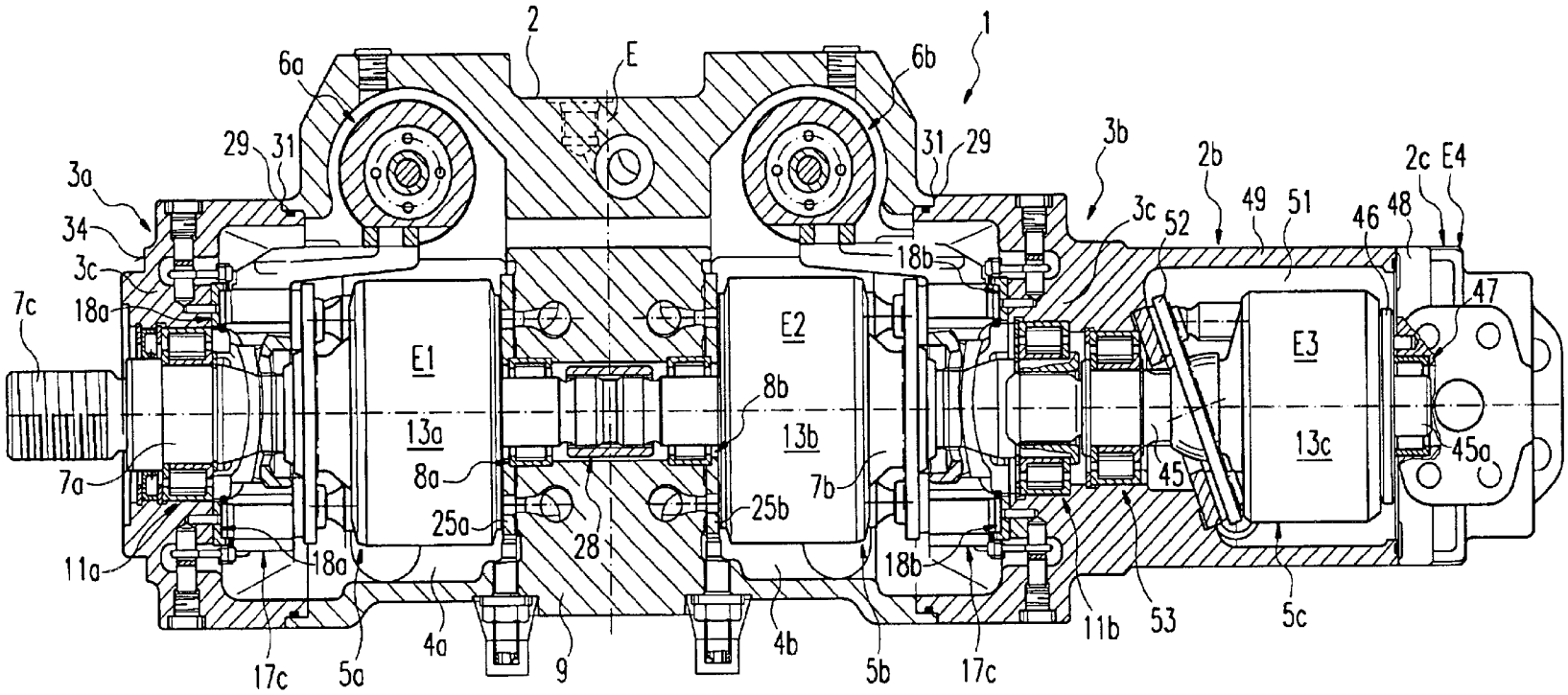
FIG. 3 shows a modified design of the machine in a position according to FIG. 1.

In the exemplary embodiment according to FIG. 3, where the same or comparable parts are likewise provided with the same reference symbols, the add-on housing body 3*b* arranged opposite the drive journal 7*c* is likewise a preferably one-piece part of a third hydraulic unit E3, which is preferably formed by a piston machine 5*c*, in particular an axial piston machine. The piston machine 5*c* may be constant or variable with respect to its throughput volume. It may be a swash-plate machine, the cylinder drum 13*c* of which is mounted in a rotationally fixed manner on an in particular one-piece drive-shaft extension 45. The drive-shaft extension 45 may, in a known manner, pass through the cylinder drum 13*c*, and also a control plate 46 arranged at the outer end side thereof, axially in receiving holes and be mounted, by a bearing journal 45*a* by means of a rotary bearing 47, on a cover 48 which may, if appropriate, be part of a fourth hydraulic unit E4, which may be an auxiliary pump with a housing 2*c*.

The cover 48 or the body of the auxiliary pump is tightly mounted, e.g. screwed, onto a peripheral wall 49 extending in one piece from the body wall 3*c* and surrounding a third working chamber 51, in which the third hydraulic unit E3 is arranged in a manner known per se. The swash plate 17*c* of the swash-plate machine 5*c* is mounted on the radial body wall 3*c*. The drive-shaft extension 45 may be a separate drive shaft, the inner drive-shaft end of which is mounted rotatably in a bearing hole of the radial body wall 3*c* by a rotary bearing 53. In both cases—drive-shaft extension 45 or separate drive shaft—two rotary bearings 11*b*, 53 may be arranged axially next to each other in the region of the radial body wall 3*c*, as shown in FIG. 3.

The hydraulic supply lines and channels for the piston machine 5*c* are of a type known per se and are not described in more detail for reasons of simplification. If the drive shaft 54 for the third piston machine 43 is a separate drive shaft, its drive-shaft end may be positively connected to the opposite drive-shaft end of the drive shaft 7*b*, for example positively by a coupling 28, as already described in the exemplary embodiment according to FIG. 1. The auxiliary pump may, for example, be a gear pump, which is described in the exemplary embodiment according to FIG. 1.

Figure 4:
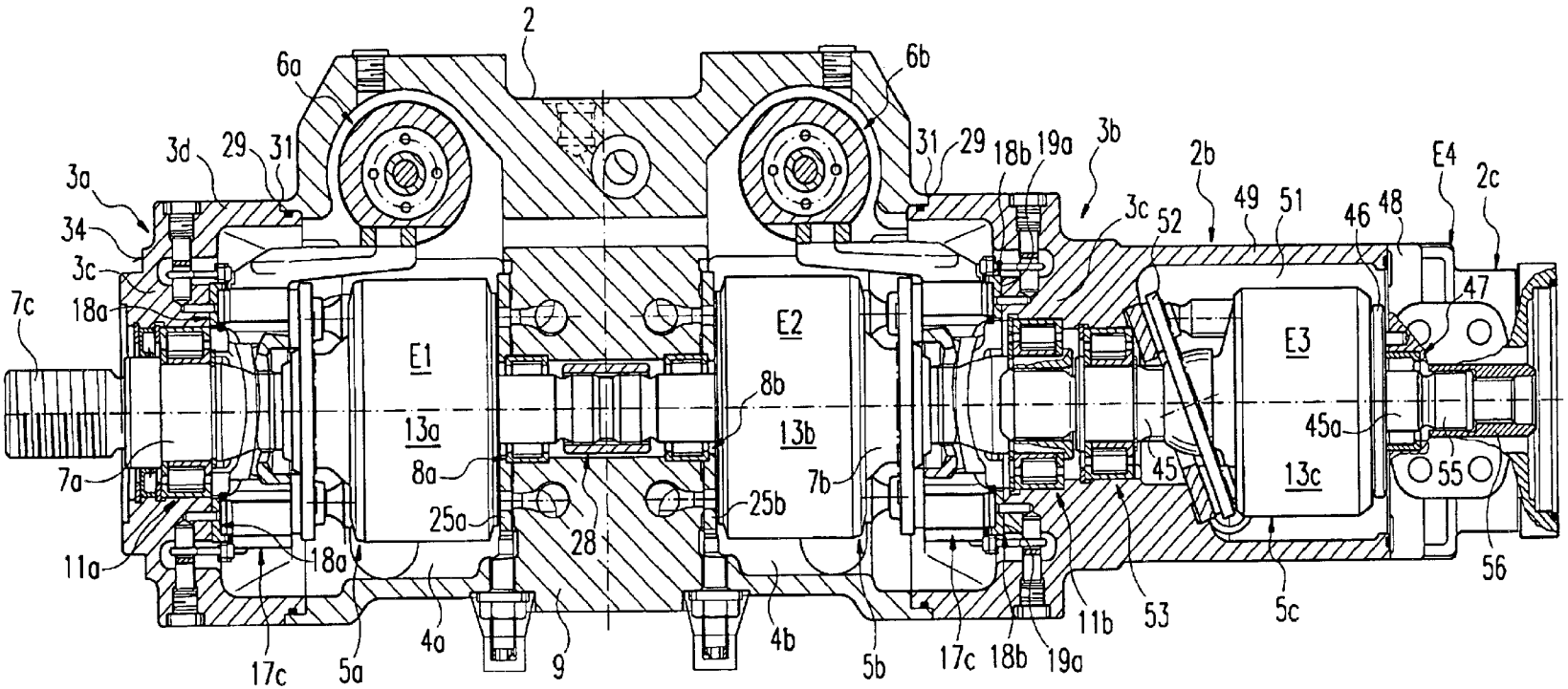
FIG. 4 shows a further-modified design of the machine according to FIG. 3 in a position according to FIG. 1.

In the exemplary embodiment according to FIG. 4, which may correspond largely to the exemplary embodiment according to FIG. 3, the axially outer bearing journal 54 of the additional drive shaft or of the drive-shaft extension 45 is coaxially extended at the end side by a coupling journal 55 which positively fits into a coupling sleeve 56, for example like a toothed or multitoothed coupling, it being possible for the coupling sleeve 56 to be a driving part of the auxiliary pump.

Figure 5:
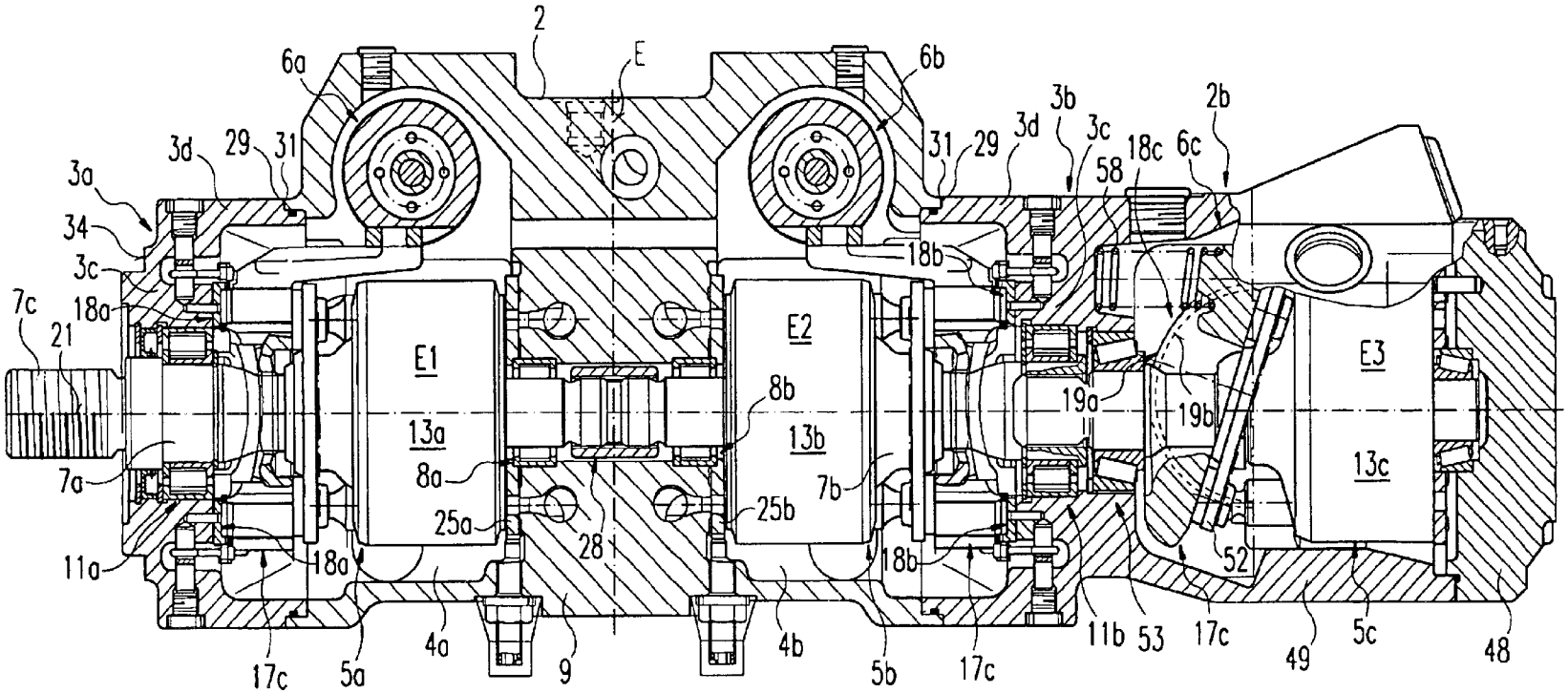
FIG. 5 shows a further-modified design of the machine according to FIG. 4.

In the exemplary embodiment according to FIG. 5, where the same or comparable parts are likewise provided with the same reference symbols, the swivelling bearing 18 of the second hydrostatic unit E2 is likewise arranged on the add-on housing body 3*b*, which is part of the housing 2*b* of the third hydrostatic unit E3, which is preferably likewise formed by a piston machine 5*c*, in particular an axial piston machine. The piston machine 5*c* is preferably variable with respect to its throughput volume, and may be a swash-plate machine, the swash plate 17*c* of which is swivellably mounted. The swivelling plane of the associated swivelling bearing 18*c* is arranged such that it is rotated through 90° with respect to the adjacent or second swivelling bearing 18*b* and also with respect to the first swivelling bearing 18*a*, as shown in FIG. 5. The swivelling bearing 18*c* may, however, also have the same swivelling plane.

Figure 6:
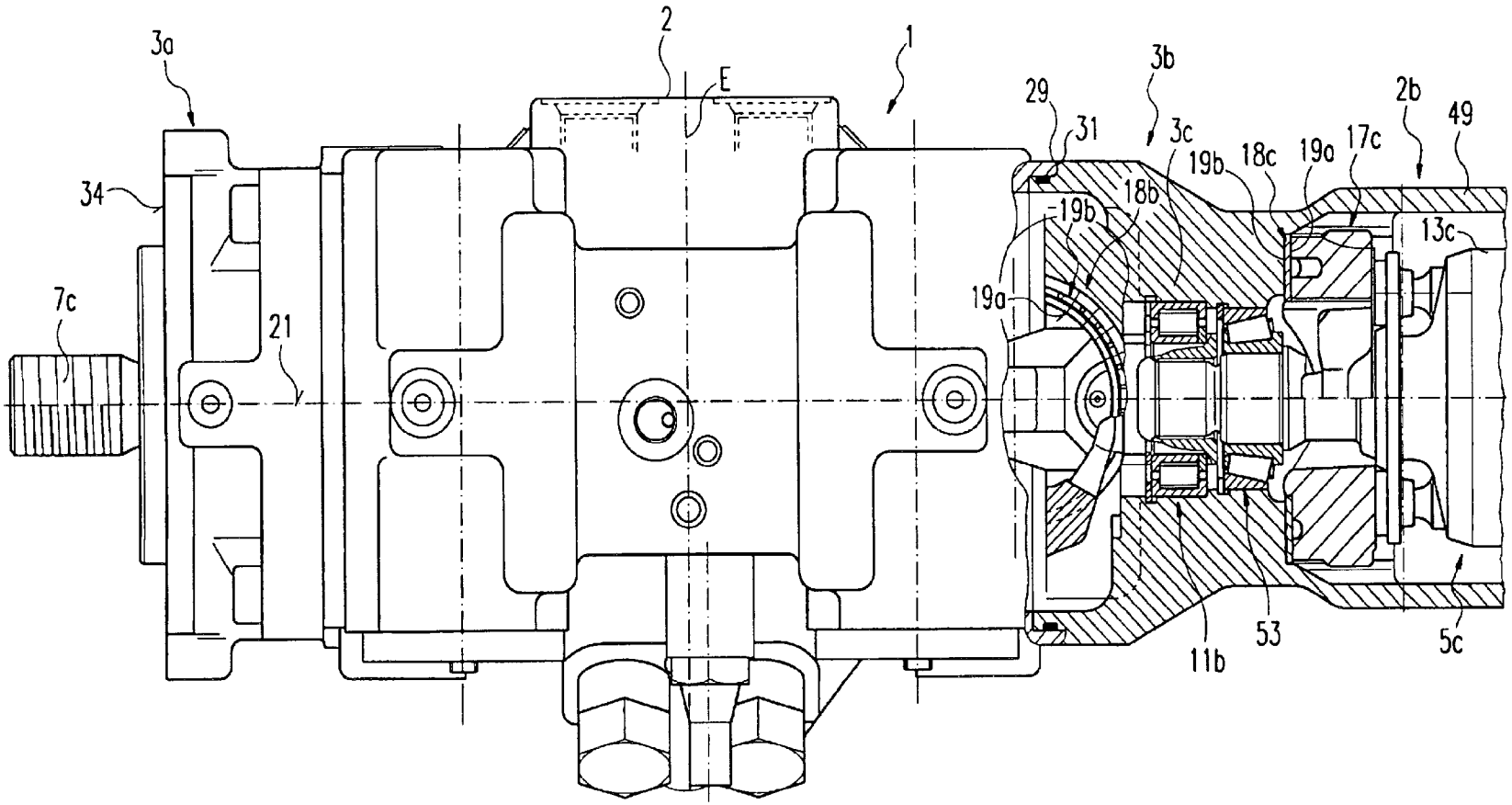
FIG. 6 shows a further-modified design of the machine according to FIG. 5.

In the case of the piston machine 5*c*, the associated adjusting device 6*c* may be an automotive adjusting device 6*c* of a type which reduces the throughput volume with rising working pressure and increases the throughput volume with falling working pressure. For this purpose, the swash plate 17*c* may be displaced by a spring into its maximum swivelling position, in which case with rising working pressure the swash plate 17*c* is displaced against the force of the spring in the direction of its minimum volume setting. In the present exemplary embodiment, the spring 58 is formed by a compression spring arranged on the pressure side of the swash plate 17*c* between the latter and the body wall 3*c*. The peripheral wall 49 of the housing 2*b* is closed, in this exemplary embodiment, by a cover 48 which bears against its edge and on which the rotary bearing 47 for the associated drive shaft is supported. This drive shaft may be a drive-shaft extension or a separate drive shaft, as already described. FIG. 6 shows the exemplary embodiment according to FIG. 5 in a partially sectioned illustration rotated through 90°.

Figure 7:
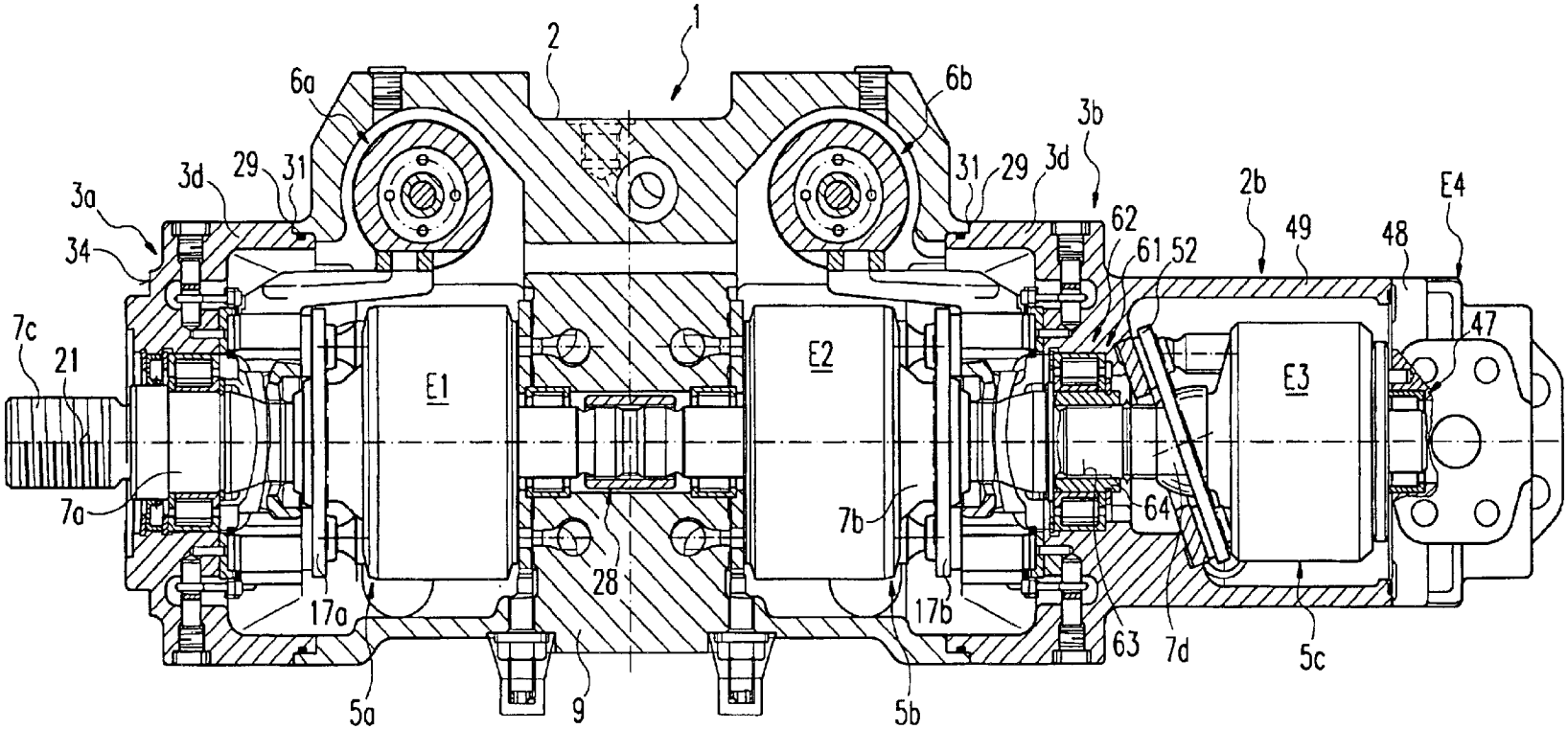
FIG. 7 shows a further-modified design of the machine according to FIG. 3.

The exemplary embodiment according to FIG. 7, where the same or comparable parts are provided with the same reference symbols, is based on the exemplary embodiment according to FIG. 3, except that a common rotary bearing 61 for the outer drive-shaft end of the drive shaft 7*b* and the inner drive-shaft end of a separate drive shaft 7*c* of the third hydrostatic unit E3 is provided. The common rotary bearing 61 is formed by the outer end of the drive shaft 7*b* and the inner end of the drive shaft 7*c* interengaging coaxially in the form of a muff, the overlapping part being rotatably mounted in a bearing of the body wall 3*c*. In the present exemplary embodiment, a common rolling bearing 52 seated on the overlapping part is provided. This is preferably formed by the outer end of the drive shaft 7*b* being designed with a coaxial, in particular hollow-cylindrical opening 63 as a bearing sleeve 64, in which the correspondingly shaped inner end of the drive shaft 7*c* is seated and is connected in a rotationally fixed manner, for example by a single- or multi-part connection or a screw-in thread.

Figure 8:
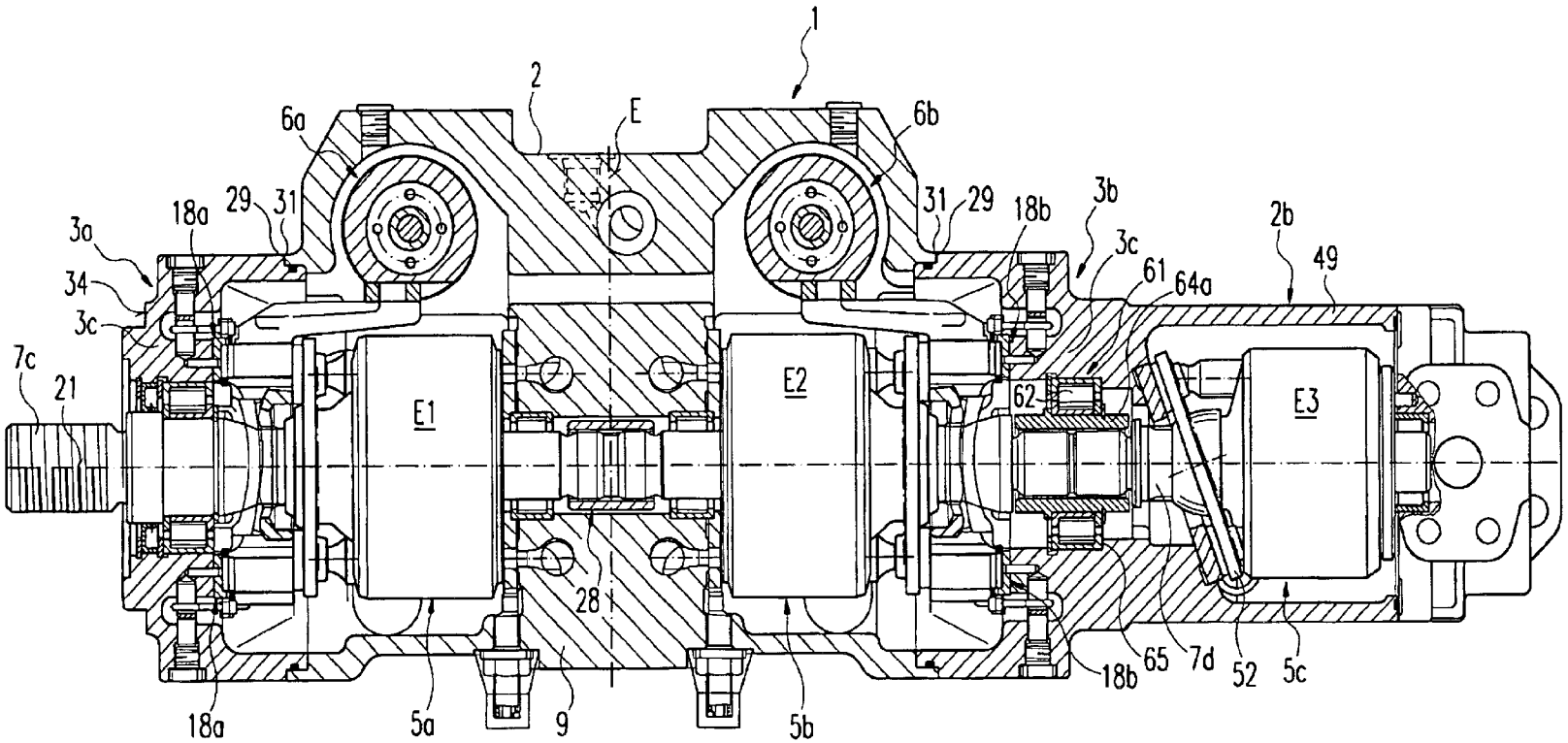
FIG. 8 shows a further-modified design of the machine according to FIG. 3.

The exemplary embodiment according to FIG. 8, where likewise the same or comparable parts are provided with the same reference symbols, differs from the exemplary embodiment according to FIG. 7 in that the common rotary bearing 61 is formed by a separate bearing sleeve 64*a*, into which the drive shafts 7*b*, 7*c* are firmly inserted from both end sides with correspondingly adapted bearing journals, for example by a keyed or screwed connection. The bearing journals may bear against each other directly by their free ends or the drive shafts 7*b*, 7*c* may bear, by shoulder surfaces, against the ends of the bearing sleeve 64 and thus be axially limited and positioned. To secure the rolling bearing 62 on the bearing sleeve 64*a*, two shoulder surfaces of the bearing sleeve 64*a* which axially limit the rolling bearing 62 are likewise provided. In the present exemplary embodiment, one shoulder surface is formed by a preferably integrally formed-on annular projection on the bearing sleeve 64, whereas the other shoulder surface is formed by a detachable securing ring seated in an annular groove. The rolling bearing 62 is mountable and demountable from the side facing the main housing body 2. It bears, by its side facing away from the main housing body 2, against a shoulder surface 65 in the housing 2*b* or in the body wall 3*c*.

In all the designs described above, one add-on housing body, according to FIG. 1 the add-on housing body 3*a*, may serve as a mounting-on flange for the multiple hydraulic unit thus formed, the other add-on housing body 3*b* assuming the function of the drive-through facility.

Owing to the connection conditions for the add-on housing bodies 3*a*, 3*b* being the same on both sides of the main housing body 2, the add-on housing bodies may be interchanged and mounting variants achieved which may be on the right or the left with respect to the drive journal 7*c* of the associated drive shaft 7*a*, as desired.

It is additionally advantageous to integrate the adjusting devices 6*a*, 6*b* into the main housing body 2, for the direct supply of the two adjusting devices 6*a*, 6*b*. This obviates the need for additional mounting-on surfaces on the main housing body 2, and additionally a small and compact construction, and one which is protected for the adjusting devices 6*a*, 6*b*, is achieved. Furthermore, it is advantageous to provide an internal tank connection and feed-circuit pressure protection only for the first and the second hydraulic unit E1, E2. Only a single tank connector is required for this. In this regard, it is advantageous to arrange the infeed in the centre of the main housing body 2 upstream of an infeed pressure relief valve. The hydraulic medium discharged via a pressure relief valve is returned to the tank via the housing chambers 4*a*, 4*b* by means of an internal connection at the tank connector.

The front add-on housing body 3*a*, surrounding the drive-shaft journal 7*c* or situated in the vicinity thereof, may form a flange for mounting on the complete multiple hydraulic unit, while ensuring a stable construction and fastening. In this case, the other or rear add-on housing body 3*b* carries the drive-shaft bearing and the swivelling-body bearing of the second hydraulic unit, and it may also carry a cast-on housing with suction and pressure connectors for a third hydraulic unit E3, for example a gear machine or a piston machine. In this regard, different drive-through versions can also be constructed. As a result, a drive-through adapter and the flanging-on plate of the third hydraulic unit can be dispensed with. In addition, this design leads to a substantial reduction in the overall length.

Owing to the symmetrical design of the main housing body 2 with respect to its transversely running centre plane E and a correspondingly symmetrical arrangement and design of the add-on housing bodies 3*a*, 3*b*, the latter may be mounted on as desired. Mounting variants are thereby achieved. By rotating the add-on housing bodies 3*a*, 3*b* through 180° in a longitudinal plane containing their centre axis 21, various structural concerns may be satisfied and direction-of-rotation versions achieved.

By combining the drive-shaft bearings of the second and third hydraulic unit E2, E3 (FIGS. 7 and 8), a rotary bearing is saved and a reduction in the overall length is also achieved. These designs may also be implemented in the other exemplary embodiments.

It is advantageous, furthermore, to construct a coupling 28 between the drive shafts 7*a*, 7*b* or else 7*c* to be in each case movable in all directions like a spatial joint, for example to be "crowned", in order to avoid deflections of the drive shafts due to unavoidable tolerances.

What is claimed is:

1. Hydrostatic machine (1) comprising at least one first hydrostatic unit (E1) and one second hydrostatic unit (E2), each hydrostatic unit (E1, E2) having respective pistons (14*a*, 14*b*) guided in respective cylinder drums (13*a*, 13*b*) and supported by respective swivelling bodies (17*a*, 17*b*) which can be adjusted by respective adjusting devices (6*a*, 6*b*), and having respective control bodies (25*a*, 25*b*), and a one-piece main housing body (2) which radially surrounds the cylinder drums (13*a*, 13*b*), the control bodies (25*a*, 25*b*) and the adjusting devices (6*a*, 6*b*) of both hydrostatic units (E1, E2) and has pressure channels for supplying a pressure medium to and discharging it from the control bodies (25*a*, 25*b*) of both hydrostatic units (E1, E2), characterised by a first add-on housing body (3*a*) which is arranged on a first side of the main housing body (2) and on which the swivelling body (17*a*) of the first hydrostatic unit (E1) is mounted, and a second add-on housing body (3*b*) which is arranged on a second side of the main housing body (2) and on which the swivelling body (17*b*) of the second hydrostatic unit (E2) is mounted.

2. Hydrostatic machine according to claim 1, characterised in that the swivelling bodies (17*a*, 17*b*) are each swivellably mounted, by circular-segment-shaped convex bearing surfaces (19*a*), on concave circular-segment-shaped bearing surfaces (19*b*) arranged internally on the add-on housing bodies (3*a*, 3*b*).

3. Hydrostatic machine according to claim 1, characterised in that the add-on housing bodies (3*a*, 3*b*) are each formed by an approximately radially extending body wall (3*c*) and a peripheral wall (3*d*) extending from the latter in the direction of the main housing body (2).

4. Hydrostatic machine according to claim 1, characterised in that the cylinder drums (13*a*, 13*b*) are mounted on drive shafts (7*a*, 7*b*), the outer drive-shaft ends of which are each supported on the associated add-on housing body (3*a*, 3*b*) by a rotary bearing (11*a*, 11*b*).

5. Hydrostatic machine according to claim 1, characterised in that the adjusting devices (6*a*, 6*b*) are integrated into the main housing body (2), in particular in chamber extensions of housing chambers (4*a*, 4*b*) of the main housing body (2) which receive the cylinder drums (13*a*, 13*b*).

6. Hydrostatic machine according to claim 1, characterised in that the hydrostatic units (E1, E2) are formed by axial piston machines (5*a*, 5*b*).

7. Hydrostatic machine according to claim 6, characterised in that one add-on housing body or both add-on housing bodies (3*a*, 3*b*) is or are mountable in positions on the main housing body (2) which are arranged such that they are rotated through 180° relative to each other about the axis of rotation (21) of the associated cylinder drum (13*a*, 13*b*).

8. Hydrostatic machine according to claim 1, characterised in that the first side and the second side of the main housing body (2) are mutually opposite sides.

9. Hydrostatic machine according to claim 1, characterised in that the bearing surfaces, bearing against each other, between the main housing bodies (2) and the add-on housing bodies (3*a*, 3*b*), and also the arrangements of the swivelling bodies (17*a*, 17*b*) on the associated add-on housing bodies (3*a*, 3*b*) are each arranged mirror-symmetrically with respect to a centre plane (11) of the main housing body (2) extending between the cylinder drums (13*a*, 13*b*) at right angles to their common axis of rotation (21).

10. Hydrostatic machine according to claim 1, characterised in that the swivelling bodies (17) and the cylinder drums (13*a*, 13*b*) are arranged in housing chambers (4*a*, 4*b*) and are mountable and demountable through housing openings closed by the add-on housing bodies (3*a*, 3*b*).

11. Hydrostatic machine according to claim 1, characterised in that one of the two add-on housing bodies (3*a*, 3*b*) is a one-piece or two-piece part of the housing (2*c*) of a third unit (E3).

12. Hydrostatic machine according to claim 11, characterised in that the third unit (E3) is formed by a piston machine (5*c*), in particular an axial piston machine, or a gear machine.

13. Hydrostatic machine according to claim 12, characterised in that the axial piston machine (5*c*) has a swash plate (17*a*, 17*b*) which is mounted on the side of the add-on housing body (3*b*) facing away from the main housing body (2).

14. Hydrostatic machine according to claim 13, characterised in that circular-segment-shaped concave bearing surfaces (18*a*) for a swivelling body (17*c*) of the piston machine (5*c*) of the third hydraulic unit (E3) are arranged on the side of the add-on housing body (3*b*) facing away from the main housing body (2).

15. Hydrostatic machine according to claim 11 , characterised in that the third unit (E3) is mounted on an extension (45) of the drive shaft (7*b*) of the adjacent second hydrostatic unit (E2) or is mounted on a separate drive shaft (7*c*), the inner end of which is mounted on the associated add-on housing body (3*b*).

16. Hydrostatic machine according to claim 15, characterised in that a common rotary bearing (61) for the drive shaft (7*b*) of the second hydrostatic unit (E2) and for the drive shaft (7*c*) of the third unit (E3) is formed on the add-on housing body (3*b*).

17. Hydrostatic machine according to claim 1, characterised in that the direction of rotation of the hydrostatic machine (1) is reversible by exchanging the control bodies (25*a*, 25*b*).

* * * * *